US008496128B2

(12) United States Patent
Gagliardino

(10) Patent No.: US 8,496,128 B2
(45) Date of Patent: Jul. 30, 2013

(54) ROTARY COUPLER FOR A RAILWAY CAR

(75) Inventor: Joseph L. Gagliardino, Oakdale, PA (US)

(73) Assignee: McConway & Torley LLC, Dallas, TX (US)

( * ) Notice: Subject to any disclaimer, the term of this patent is extended or adjusted under 35 U.S.C. 154(b) by 120 days.

(21) Appl. No.: 12/910,561

(22) Filed: Oct. 22, 2010

(65) Prior Publication Data

US 2012/0097631 A1 Apr. 26, 2012

(51) Int. Cl.
*B61G 9/00* (2006.01)

(52) U.S. Cl.
USPC ..... 213/62 A

(58) Field of Classification Search
USPC ..... 213/62 A; 29/527.5
See application file for complete search history.

(56) References Cited

U.S. PATENT DOCUMENTS 3,220,562 A 11/1965 Baker ..... 213/62
3,250,403 A 5/1966 Tack et al. ..... 213/62
4,093,079 A 6/1978 Cope
4,635,804 A 1/1987 Hanula
4,984,696 A * 1/1991 Altherr ..... 213/151
5,312,007 A * 5/1994 Kaufhold et al. ..... 213/75 R
5,507,400 A 4/1996 Long et al. ..... 213/75 R

OTHER PUBLICATIONS

International Search Report and Written Opinion; International Application No. PCT/US2011/056623; pp. 10, Jan. 12, 2012.

* cited by examiner

*Primary Examiner* — S. Joseph Morano
*Assistant Examiner* — Zachary Kuhfuss
(74) *Attorney, Agent, or Firm* — Baker Botts L.L.P.

(57) ABSTRACT

A railcar coupler system that includes a yoke comprising a front end, a rear end, a top strap, and a bottom strap. The top strap and the bottom strap are positioned between the front end and the rear end. The front end comprises an internal bearing surface that is obliquely angled with respect to a central axis of the yoke that extends from the front end to the rear end of the yoke. The system also includes a connector configured to rotate within the yoke such that an axis of rotation of the connector is substantially aligned with the central axis of the yoke when the connector is positioned within the yoke. The connector includes an external bearing surface that is obliquely angled with respect to the axis of rotation of the connector and configured to correspond to the internal bearing surface of the yoke.

20 Claims, 4 Drawing Sheets

ROTARY COUPLER FOR A RAILWAY CAR

TECHNICAL FIELD

The present disclosure is related to railway car coupling, and more particularly to rotary couplers for a railway car.

BACKGROUND

Rotary couplers are used in coupling rotary dumpers, hoppers, tipplers or wagons (collectively, rotary railcars) to other railcars, including rotary and non-rotary railcars. The rotary coupler allows the rotary car to be unloaded by rotating the entire rotary car in place, track and all, while the rotary car remains coupled to the other railcars. The rotary coupler facilitates in the rotation by providing a connecter that fits within a yoke. Within the yoke, the connector is able to rotate by approximately 360 degrees. In a traditional rotary coupler, the connector and the yoke each have a corresponding bearing surface that is perpendicular to an axis of rotation about which the connector rotates.

A rotary coupler experiences significant forces, in addition to the rotational forces, as the rotary railcar is engaged and pulled along the track. Over time, the combination of the pulling forces and the rotational forces may cause the rotary coupler to fail. One common failure point for a rotary coupler is at the bearing surfaces of the yoke and/or connector.

SUMMARY

The teachings of the present disclosure relate to a railcar coupler system that includes a yoke comprising a front end, a rear end, a top strap and a bottom strap. The top strap and the bottom strap are positioned between the front end and the rear end. The front end comprises an internal bearing surface that is obliquely angled with respect to a central axis of the yoke that extends from the front end to the rear end of the yoke. The system also includes a connector configured to rotate within the yoke such that an axis of rotation of the connector is substantially aligned with the central axis of the yoke when the connector is positioned within the yoke. The connector includes an external bearing surface that is obliquely angled with respect to the axis of rotation of the connector and configured to correspond to the internal bearing surface of the yoke.

Technical advantages of particular embodiments include improving the longevity of a rotary coupler through reduced wear and improved distribution of forces on the bearing surfaces of a yoke and/or connector. Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

A more complete understanding of particular embodiments will be apparent from the detailed description taken in conjunction with the accompanying drawings in which.

DETAILED DESCRIPTION OF THE DRAWINGS

Figure 1:
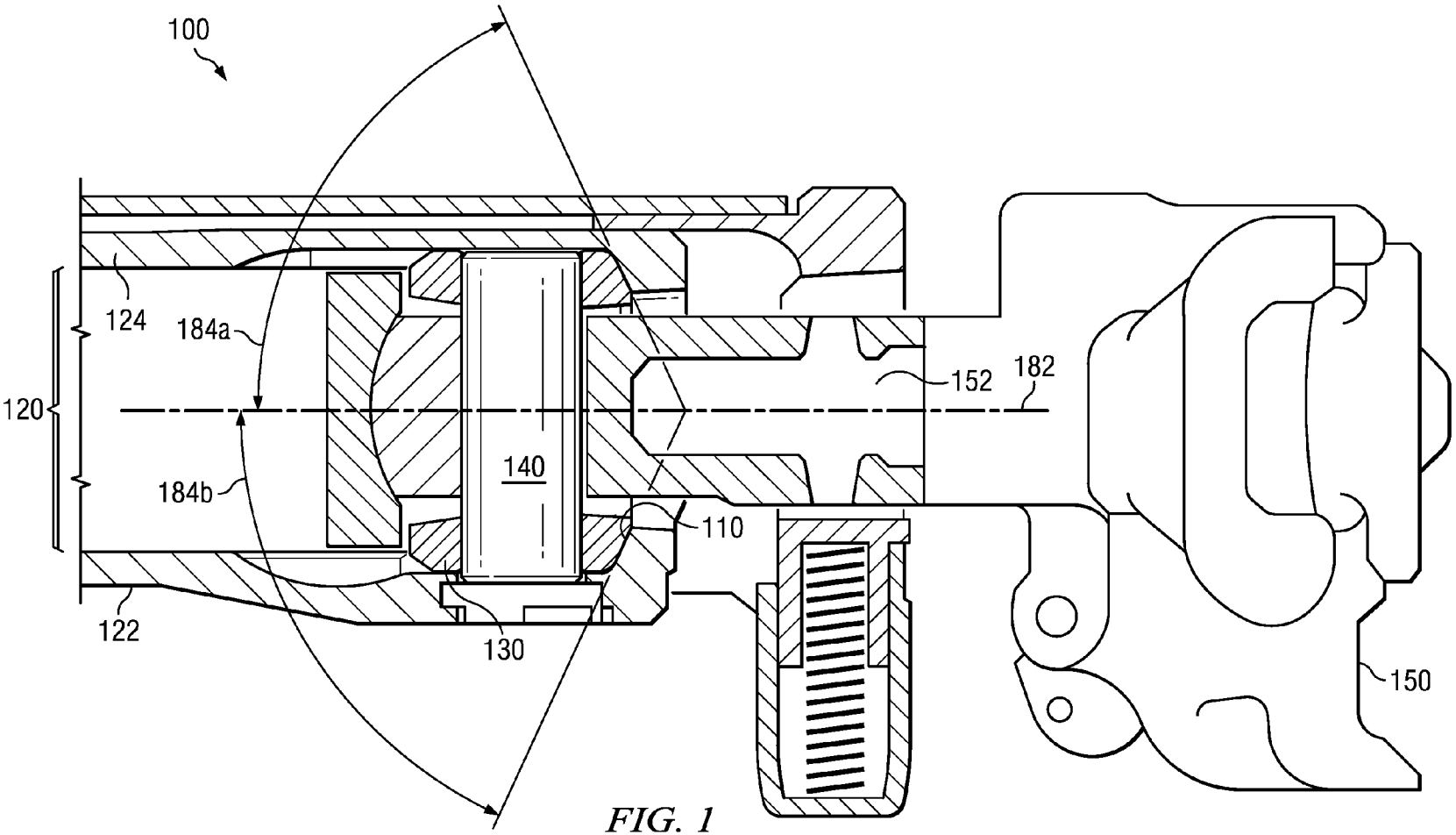
FIG. 1 is a profile view of a rotary coupler comprising a rotary connector and a rotary yoke, in accordance with particular embodiments.

FIG. 1 is a profile view of a rotary coupler comprising a rotary connector and a rotary yoke, in accordance with particular embodiments. Rotary coupler 100 may be used in coupling a rotary railcar with other railcars, including both rotary railcars and non-rotary railcars. Depending on the scenario, a rail car, such as a rotary railcar, may be configured to include rotary coupler 100 at one or both ends of the railcar. Rotary coupler 100 allows a rotary railcar to be rotated approximately 180 degrees without having to be un-coupled from its neighboring railcars.

Rotary coupler 100 includes coupler head 150 which may join with a corresponding coupler head of another railcar to couple together two railcars. The other railcar need not also have a rotary coupler—each coupling of two railcars need have only one rotary coupler between the two railcars. Attached to coupler head 150 is coupler shaft 152. Coupler shaft 152 extends into rotary yoke 120 and through rotary connector 130. Coupler shaft 152 is held in place within rotary connector 130 by connector pin 140.

Rotary connector 130 fits within rotary yoke 120 and is able to rotate therein. Rotary connector 130 may rotate about an axis of rotation that is substantially aligned with central axis 182 of rotary yoke 120 (see central axis 282 and axis of rotation 283 of FIG. 2). Central axis 182 of rotary yoke 120 may run along the length of rotary yoke 120 between bottom strap 122 and top strap 124.

To keep rotary connector 130 within rotary yoke 120 so that rotary connector 130 does not pull out during pulling operations of the railcar, both rotary yoke 120 and rotary connector 130 comprise corresponding obliquely angled bearing surfaces collectively identified as bearing surfaces 110. Bearing surfaces 110 may be angled between approximately 74 and 60 degrees as measured from central axis 182 of rotary yoke 120. For example, in particular embodiments bearing surfaces 110 may be angled approximately 65 degrees as measured from central axis 182 of rotary yoke 120. While angle 184 is illustrated as opening towards the rear end of rotary coupler 100, in particular embodiments, angle 184 may open towards the head end of rotary coupler 100. Angle 184 may reduce the failure rate of rotary coupler 100 as compared to a traditional rotary coupler in which the bearing surfaces are substantially perpendicular to central axis 182.

Figure 2:
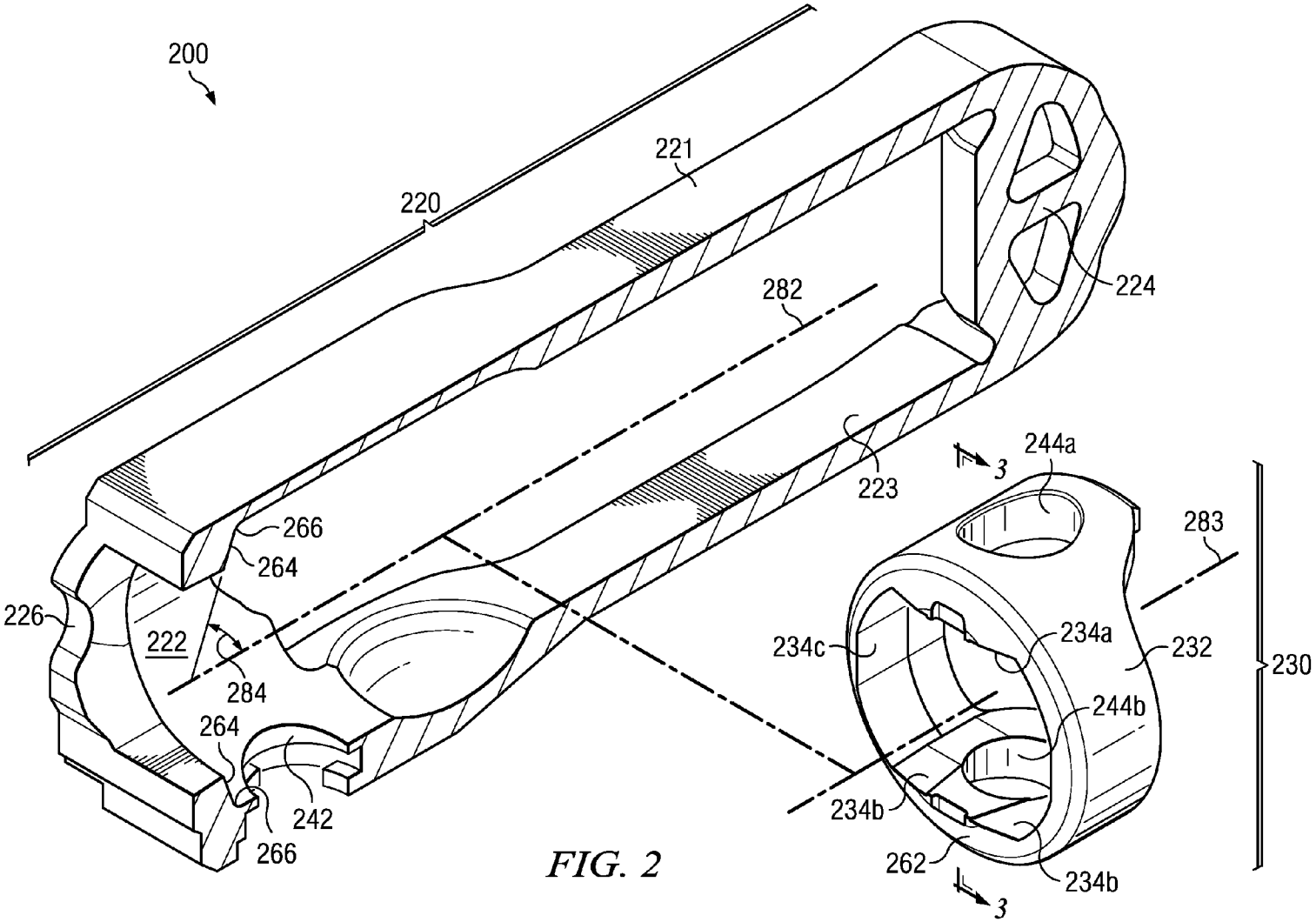
FIG. 2 is an exploded cross-sectional perspective view of a rotary connector and rotary yoke, in accordance with particular embodiments.

FIG. 2 is an exploded cross-sectional perspective view of a rotary connector and rotary yoke, in accordance with particular embodiments. Rotary yoke 220 includes rear end 224 and front end 226 which are separated by top strap 221 and bottom strap 223. These components form a pocket within which rotary connector 230 and a coupler shaft (e.g., coupler shaft 152) may be positioned.

At front end 226, rotary yoke 220 includes a substantially cylindrical inner surface 222. Inner surface 222 extends around the internal perimeter of front end 226. This provides a cylindrical surface within which rotary connector 230 may rotate.

At the front end of inner surface 222 is bearing surface 264. Unlike a traditional rotary yoke in which the bearing surface is substantially perpendicular to central axis 282 of the yoke, bearing surface 264 is angled between approximately 74 and 60 degrees from central axis 282 of rotary yoke 220. For example, in particular embodiments, angle 284 of bearing surface 264 is approximately 65 degrees from central axis 282. In the illustrated embodiment, bearing surface 264 is angled towards front end 226 and central axis 282. In some embodiments, bearing surface 264 maybe angled towards rear end 224 and central axis 282. The angling of bearing surface 264 may help to prolong the life of rotary yoke 220 as compared to a traditional rotary yoke by improving the distribution of forces (e.g., pulling forces or rotational forces) applied to bearing surface 264.

Situated between inner surface 222 and bearing surface 264 is union surface 266. Union surface 266 may provide a rounded transition from inner surface 222 to bearing surface 264. Depending on the embodiment, the curve of the rounded transition provided by union surface 266 may be based on a circle having a radius of approximately one-half of one inch. In some embodiments, such a radius may fall within a range of approximately 0.375 to 0.75 inches.

As mentioned above, rotary connector 230 is positioned within rotary yoke 220 and is able to rotate about axis of rotation 283. Axis of rotation 283 may be substantially aligned with central axis 282 of rotary yoke 220. Outside surface 232 of rotary connector 230 is substantially cylindrical and corresponds with the substantially cylindrical inner surface 222 of rotary yoke 220. Rotary connector 230 may include a top and bottom portion with internal flat surfaces 234*a* and 234*b*. Rotary connector 230 may also include a side portion with an internal flat surface 234*c*. Rotary connector 230 may further include a similar side internal flat surface along the side that is hidden in the illustration. Flat surfaces 234 provide rotary connector 230 with an internal shape that more closely matches the shape of a coupler shaft which may be inserted therein. With rotary connector 230 inserted in rotary yoke 220, a connector pin may be inserted through connector pin openings 244*a* and 244*b* and a corresponding opening through the coupler shaft. The connector pin holds the coupler shaft in place within rotary connector 230.

Along the front edge of rotary connector 230 is bearing surface 262. Bearing surface 262 may correspond to bearing surface 264 of rotary yoke 220. Unlike the substantially perpendicular bearing surface of a traditional rotary connector, bearing surface 262 is angled between approximately 74 and 60 degrees from axis of rotation 283 of rotary connector 230. For example, in particular embodiments, bearing surface 262 is angled 65 degrees from axis of rotation 283. In the depicted embodiment, bearing surface 262 is angled towards front end 226 and axis of rotation 283. In some embodiments, bearing surface 262 may be angled towards rear end 224 and axis of rotation 283. In the illustrated embodiment, bearing surface 262 is wider where it is adjacent to flat surfaces 234 than at the remaining portions of the bearing surface. Because bearing surface 262 is angled, the additional width of flat surfaces 234 results in the adjacent portions of bearing surface 262 extending out further towards nose end 226 than the other portions of the bearing surface. The angling of bearing surface 262 may help to prolong the life of rotary connector 230 as compared to a traditional rotary coupler by improving the distribution of rotational and/or pulling forces that are applied to rotary connector 230 and/or rotary yoke 220.

Figure 3:
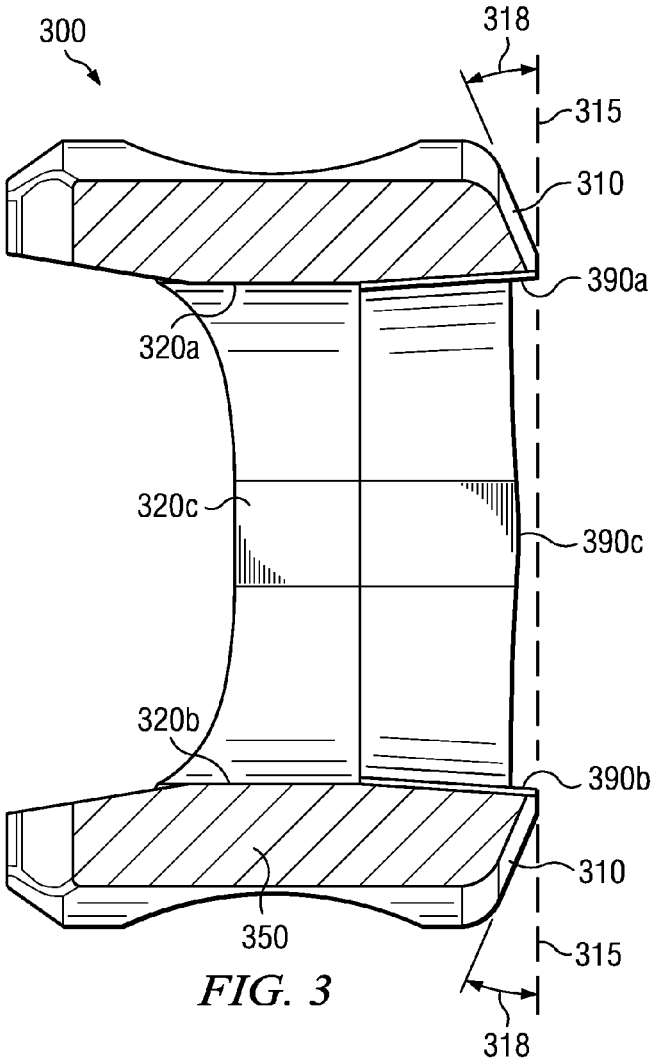
FIG. 3 is a cross sectional side view of a rotary connector, in accordance with particular embodiments.

FIG. 3 is a cross sectional side view of a rotary connector, in accordance with particular embodiments. The depicted view of rotary connector 300 is taken along line 3-3 of FIG. 2. Rotary connector 300 includes obliquely angled bearing surface 310. Bearing surface 310 may correspond to bearing surface 262 depicted in FIG. 2. Unlike a traditional rotary connector in which the bearing surface would be substantially vertical, bearing surface 310 is angled between approximately 16 and 30 degrees, as measured from vertical line 315. For example, in particular embodiments, angle 318 of bearing surface 310 is angled approximately 25 degrees as measured from vertical line 315. In the illustrated embodiment, bearing surface 310 is angled towards a front end of a yoke (e.g., front end 226 of FIG. 2) and a central axis of the yoke (e.g., central axis 282 of FIG. 2).

In particular embodiments, flat surfaces 320*a*, 320*b*, and 320*c* may increase the width or thickness of perimeter wall 350 of rotary connector 300. The added width of flat surfaces 320*a*, 320*b*, and 320*c* may result in the adjacent portions of bearing surface 310 extending out a greater distance. This extension is shown as protrusions 390 in which protrusion 390*a* is adjacent to flat surface 320*a*, protrusion 390*b* is adjacent to flat surface 320*b*, and protrusion 390*c* is adjacent to flat surface 320*c*. More specifically, in particular embodiments, bearing surface 310 may be angled at a constant angle along the perimeter of rotary connector 300. In areas in which wall 350 of rotary connector 300 is thicker, such as along flat surfaces 320, bearing surface 310 is longer and so extends out farther than other areas of bearing surface 310, such as where the interior shape of wall 350 of rotary connector 300 is curved.

Figure 4:
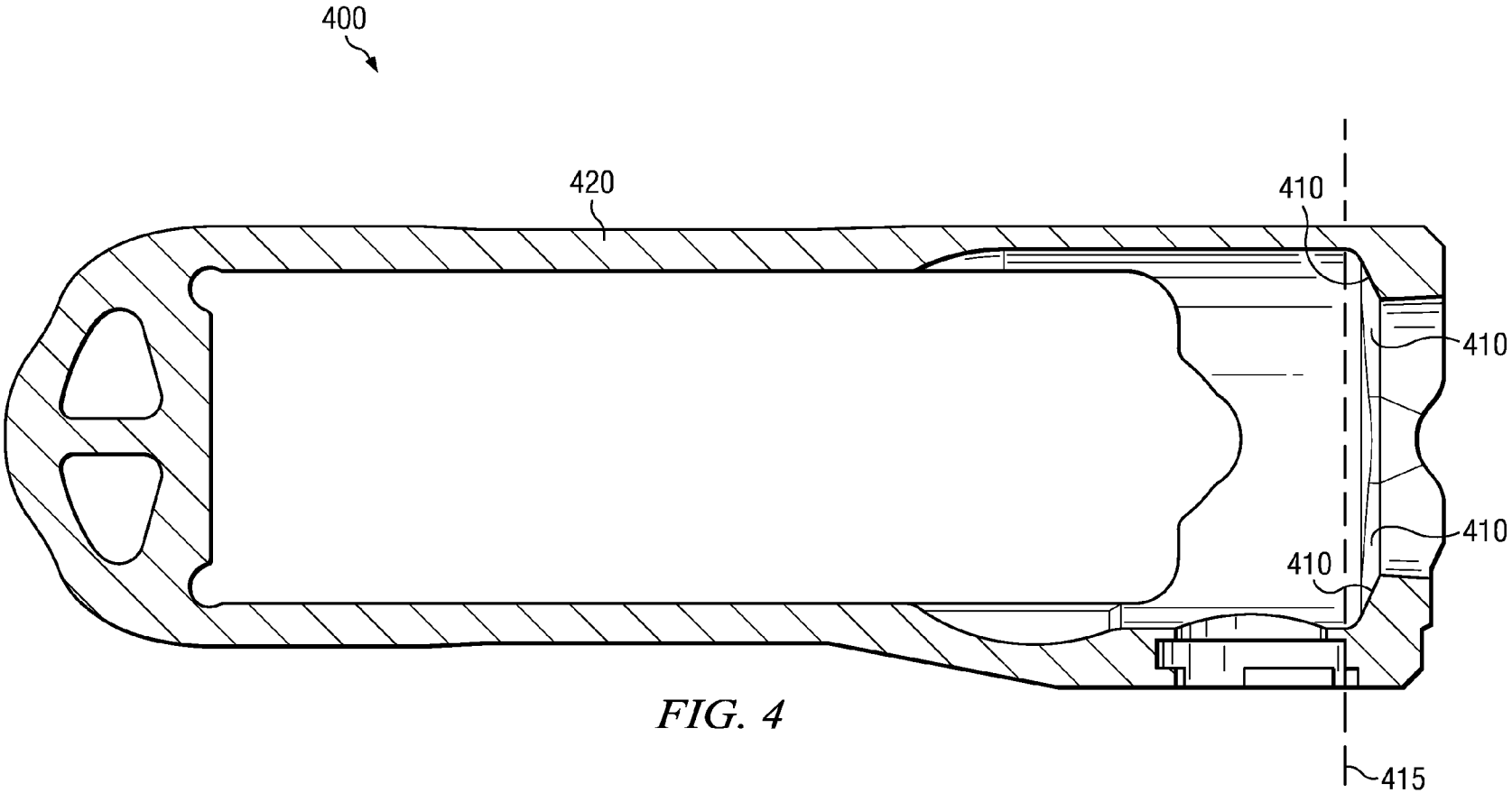
FIG. 4 is a cross sectional side view of a rotary yoke, in accordance with particular embodiments.

FIG. 4 is a cross sectional side view of a rotary yoke, in accordance with particular embodiments. The depicted view of rotary yoke 400 may be from a straight-on perspective of rotary yoke 220 of FIG. 2. Rotary yoke 400 comprises an angled bearing surface 410. Bearing surface 410 may be similar to bearing surface 264 discussed above with respect to FIG. 2. Unlike a traditional rotary yoke in which the bearing surface would be substantially vertical, bearing surface 410 is angled out from vertical line 415 between approximately 16 and 30 degrees (e.g., as measured from where bearing surface 410 meets the bottom surface of top strap 420). For example, in particular embodiments, bearing surface 410 is angled approximately 25 degrees out from vertical line 415. The angling of bearing surface 410 may correspond to the similarly angled bearing surface 310 of rotary connector 300 depicted in FIG. 3. The angling of bearing surface 410 may increase the life expectancy of rotary yoke 400 as compared to a traditional rotary yoke in which the bearing service is substantially vertical. For example, the angling of bearing surface 410 may help distribute the forces experienced by bearing surface 410.

Figure 5:
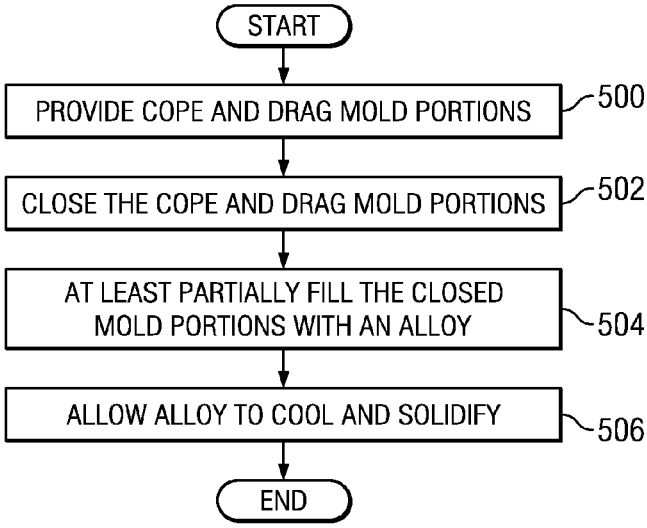
FIG. 5 is a method for manufacturing a rotary coupler, in accordance with particular embodiments.

FIG. 5 is a method for manufacturing a rotary coupler, in accordance with particular embodiments. The rotary coupler may be formed in a mold cavity within a casting box between cope and drag sections. Sand, such as green sand, may be used to define the interior boundary walls of the mold cavity. The mold cavity may be formed using a pattern and may include a gating system for allowing molten alloy to enter the mold cavity. The method begins at step 500 where cope and drag mold portions are provided. The cope and drag mold portions may each include internal walls, formed of sand using a pattern or otherwise, that define at least in part surfaces of a yoke mold cavity and a connector mold cavity. The two mold cavities may be part of the same cope and drag mold portions or they may each have their own respective cope and drag mold portions. Each mold cavity corresponds to the desired shape and configuration of a yoke and/or a connector, respectively, to be cast using the cope and drag mold portions, such as the yokes and connectors described herein with respect to particular embodiments.

At step 502, the cope and drag mold portions are closed using any suitable machinery. At step 504, the mold cavities are at least partially filled, using any suitable machinery, with a molten alloy which solidifies to form the yoke and the connector. In some embodiments, one or more cores may be inserted in the mold cavity or coupled to each other and/or the mold cavity to form various openings or cavities of the yoke or connector. After the mold is filled with a molten alloy, at step 506 the alloy eventually cools and solidifies into the yoke and connector used in a rotary coupler having one or more features described herein.

Although particular embodiments and their advantages have been described in detail, it should be understood that various changes, substitutions, and alterations can be made herein without departing from the spirit and scope of the invention as defined by the appended claims. For example, while the angled bearing surface has been described with respect to a rotary coupler, other types of couplers may use an angled bearing surface. As another example, while the bearing surfaces have been illustrated as being angled towards a front end and a central axis of a yoke, other embodiments may comprise bearing surfaces angled towards a rear end and the central axis of the yoke.

The invention claimed is:

1. A railcar coupler system, comprising:

a yoke comprising a front end, a rear end, a top strap and a bottom strap, the top strap and the bottom strap positioned between the front end and the rear end;

wherein the front end comprises an internal bearing surface that is obliquely angled with respect to a central axis of the yoke that extends from the front end to the rear end of the yoke;

a connector configured to rotate within the yoke such that an axis of rotation of the connector is substantially aligned with the central axis of the yoke when the connector is positioned within the yoke, the connector comprising an external bearing surface that is obliquely angled with respect to the axis of rotation of the connector and configured to correspond to the internal bearing surface of the yoke; and wherein the connector surrounds a coupler shaft portion of a coupler such that the external bearing surface does not engage the coupler shaft portion.

2. The railcar coupler system of claim 1, wherein the internal bearing surface is obliquely angled between approximately 74 and 60 degrees with respect to the central axis.

3. The railcar coupler system of claim 1, wherein the internal bearing surface is obliquely angled at approximately 65 degrees with respect to the central axis.

4. The railcar coupler system of claim 1, wherein the connector is configured to receive a rotary coupler along the axis of rotation.

5. The railcar coupler system of claim 1, wherein the internal bearing surface is angled towards the front end of the yoke and the central axis.

6. The railcar coupler system of claim 1, wherein the front end comprises a substantially cylindrical internal surface within which the connector is positioned.

7. The railcar coupler system of claim 6, wherein the yoke further comprises a rounded union surface between the internal cylindrical surface and the internal bearing surface.

8. The railcar coupler system of claim 7, wherein the rounded union surface is based on a circle having a half-inch radius.

9. A method for manufacturing a rotary coupler, comprising:

forming a yoke comprising a front end, a rear end, a top strap and a bottom strap, the top strap and the bottom strap positioned between the front end and the rear end;

wherein the front end comprises an internal bearing surface that is obliquely angled with respect to a central axis of the yoke that extends from the front end to the rear end of the yoke;

forming a connector configured to rotate within the yoke such that an axis of rotation of the connector is substantially aligned with the central axis of the yoke when the connector is positioned within the yoke, the connector comprising an external bearing surface that is obliquely angled with respect to the axis of rotation of the connector and configured to correspond to the internal bearing surface of the yoke; and wherein the connector surrounds a coupler shaft portion of a coupler such that the external bearing surface does not engage the coupler shaft portion.

10. The method of claim 9, wherein the internal bearing surface is obliquely angled between approximately 74 and 60 degrees with respect to the central axis.

11. The method of claim 9, wherein the internal bearing surface is obliquely angled at approximately 65 degrees with respect to the central axis.

12. The method of claim 9, wherein the connector is configured to receive a rotary coupler along the axis of rotation.

13. The method of claim 9, wherein the internal bearing surface is angled towards the front end of the yoke and the central axis.

14. The method of claim 9, wherein the front end comprises a substantially cylindrical internal surface within which the connector is positioned.

15. The method of claim 14, wherein the yoke further comprises a rounded union surface between the internal cylindrical surface and the internal bearing surface.

16. The method of claim 15, wherein the rounded union surface is based on a circle having a half-inch radius.

17. The method of claim 9, wherein forming the yoke comprises:

providing one or more yoke mold portions that when filled with a molten alloy are configured to form the yoke; and at least partially filling the one or more yoke mold portions with a molten alloy, the molten alloy solidifying after filling to form the yoke.

18. The method of claim 9, wherein forming the connector comprises:

providing one or more connector mold portions that when filled with a molten alloy are configured to form the connector; and at least partially filling the one or more connector mold portions with a molten alloy, the molten alloy solidifying after filling to form the connector.

19. A railcar coupler system, comprising:

a yoke comprising a front end, a rear end, a top strap and a bottom strap, the top strap and the bottom strap positioned between the front end and the rear end;

wherein the front end comprises an internal bearing surface that is obliquely angled with respect to a central axis of the yoke that extends from the front end to the rear end of the yoke;

a connector configured to rotate within the yoke such that an axis of rotation of the connector is substantially aligned with the central axis of the yoke when the connector is positioned within the yoke, the connector comprising an external bearing surface that is obliquely angled with respect to the axis of rotation of the connector and configured to correspond to the internal bearing surface of the yoke; and wherein the obliquely angled external bearing surface comprises a surface with a constant angle.

20. A method for manufacturing a rotary coupler, comprising:

forming a yoke comprising a front end, a rear end, a top strap and a bottom strap, the top strap and the bottom strap positioned between the front end and the rear end;

wherein the front end comprises an internal bearing surface that is obliquely angled with respect to a central axis of the yoke that extends from the front end to the rear end of the yoke;

forming a connector configured to rotate within the yoke such that an axis of rotation of the connector is substantially aligned with the central axis of the yoke when the connector is positioned within the yoke, the connector comprising an external bearing surface that is obliquely angled with respect to the axis of rotation of the connector and configured to correspond to the internal bearing surface of the yoke; and wherein the obliquely angled external bearing surface comprises a surface with a constant angle.

* * * * *